US005823113A

United States Patent [19]

Simeth

[11] Patent Number: 5,823,113

[45] Date of Patent: Oct. 20, 1998

[54] METHOD FOR MOISTENING A WASHING ROLLER IN A PRINTING MACHINE

[75] Inventor: Claus Simeth, Geisenheim-Johannisberg, Germany

[73] Assignee: MAN Roland Druckmaschinen AG, Germany

[21] Appl. No.: 804,006

[22] Filed: Feb. 21, 1997

[30] Foreign Application Priority Data

Feb. 23, 1996 [DE] Germany ..... 196 06 768.5

[51] Int. Cl.[6] ..... B41F 35/06

[52] U.S. Cl. ..... 101/483; 101/425

[58] Field of Search ..... 101/425, 424, 101/423, 483

[56] References Cited

U.S. PATENT DOCUMENTS

| | | | |
|---|---|---|---|
| 2,731,916 | 1/1956 | Kock | 101/425 |
| 3,049,997 | 8/1962 | Grembecki et al. | 101/425 |
| 3,120,805 | 2/1964 | Simon et al. | 101/425 |
| 3,309,993 | 3/1967 | Grembecki et al. | 101/425 |
| 3,720,805 | 3/1973 | Fitzgerald | 219/152 |
| 4,270,450 | 6/1981 | Difflipp et al. | 101/425 |
| 5,103,730 | 4/1992 | Sarda | 101/425 |
| 5,257,578 | 11/1993 | Jackson et al. | 101/425 |
| 5,277,111 | 1/1994 | Uribe et al. | 101/425 |
| 5,303,652 | 4/1994 | Gasparrini et al. | 101/425 |
| 5,584,245 | 12/1996 | Schonberg | 101/425 |

FOREIGN PATENT DOCUMENTS

| | | |
|---|---|---|
| AS 1 124 974 | 3/1962 | Germany . |
| AS 1 150 098 | 6/1963 | Germany . |
| 1 761 111 | 4/1971 | Germany . |
| 57-120444 | 7/1982 | Japan . |
| 62-134263 | 6/1987 | Japan . |
| 1-56550 | 3/1989 | Japan . |
| 1 169 668 | 11/1969 | United Kingdom . |
| 2076339 | 12/1981 | United Kingdom . |

*Primary Examiner*—Edgar S. Burr
*Assistant Examiner*—Daniel J. Colilla
*Attorney, Agent, or Firm*—Leydig, Voit & Mayer, Ltd

[57] ABSTRACT

A method and device for washing the printing cylinder of a printing machine, especially an offset rotary printing machine, in which a washing device with a washing roller with a covering capable of absorbing liquid is premoistened prior to performing the first washing operation after a long standstill period of the printing machine. As a result, the efficacy of the first washing operation after an interruption to operation of the printing machine is improved, the wear on the covering of the washing roller is reduced, and damage to the printing cylinder from a dry covering of the washing roller is avoided.

5 Claims, 4 Drawing Sheets

METHOD FOR MOISTENING A WASHING ROLLER IN A PRINTING MACHINE

FIELD OF THE INVENTION

The present invention relates to a method and device for more effectively cleaning cylinders of rotary printing presses, especially offset rotary printing presses, which have washing devices.

BACKGROUND OF THE INVENTION

Printing presses equipped with washing devices are known in the art from U.S. Pat. No. 3,049,997, United Kingdom Patent No. 1,169,668, and German Patent No. 1,124,974. The washing device of these printing presses is equipped with a rotatable washing roller with a covering, for example, a brush, a felt, or a cleaning cloth, which is capable of absorbing liquid.

To clean a cylinder in the printing press, for example the blanket cylinder, the washing device is positioned such that the washing roller is in rotational contact with the cylinder. When the washing roller and the printing cylinder are in contact, a supply of washing liquid is provided to the washing roller to clean the cylinder. The deposits on the printing cylinder are dissolved and removed by the interaction of the washing liquid, washing roller, and the printing cylinder. As a general rule, the washing roller and the printing cylinder rotate in the opposite direction from one another. To obtain optimum washing results in a short time, while avoiding overwetting the surface of the printing cylinder and minimizing the consumption of washing liquid, precise metering of the washing liquid provided during the washing operation is necessary.

A major disadvantage of present washing devices is that during relatively long standstill periods of the printing press when the washing device is not utilized (e.g., during weekend or overnight stops), the washing liquid on the washing roller evaporates and the covering of the washing roller dries-out. Because in conventional washing devices, washing fluid is only provided to the washing roller when the washing roller is in contact with the printing cylinder, the washing roller covering is not sufficiently wetted with washing liquid the first time the washing operation is performed following a long standstill period of the printing press. As a result, the effectiveness of the first washing operation after a long standstill period is impaired. Further, the covering material of the washing roller is comparatively stiff during the first washing operation after a long standstill period and therefore is exposed to a higher degree of wear during the first washing operation than during subsequent washing operations. The stiff covering material also can cause damage to the surface of the printing cylinder being cleaned.

OBJECTS AND SUMMARY OF THE INVENTION

It is the general object of the invention to provide a method and device for cleaning printing cylinders in a printing press whereby the first washing operation after a long standstill period of the printing press is as effective and optimal as subsequent washing operations.

It is another object of the invention to premoisten the covering of the washing roller prior to the performance of the first washing operation after a long standstill period of the printing press.

A further object of the invention is to minimize the degree of wear to the covering of the washing roller during the first washing operation by adequately premoistening the covering prior to the first washing operation after a long standstill period of the printing press.

It is yet another object of the invention to minimize damage to the surface of the printing cylinder by adequately moistening the covering of the washing roller prior to the first washing operation after a long standstill period of the printing press.

The objects of the invention are accomplished by providing a washing device with a washing roller which is adequately wetted prior to the first washing operation after a long standstill period. When the printing press is first started up after a long standstill period, the washing roller begins to rotate and an amount of washing liquid is applied to the washing roller to moisten the covering of the washing roller. The washing roller is not in contact with the printing cylinder while the covering is premoistened. After the covering has been sufficiently wetted, the washing device can be actuated such that the washing roller is in rotational contact with the printing cylinder for cleaning the surface of the printing cylinder.

Other objects and advantages of the invention will become apparent upon reading the following detailed description and upon reference to the drawings, in which:

DETAILED DESCRIPTION OF THE ILLUSTRATED EMBODIMENT

Figure 1:
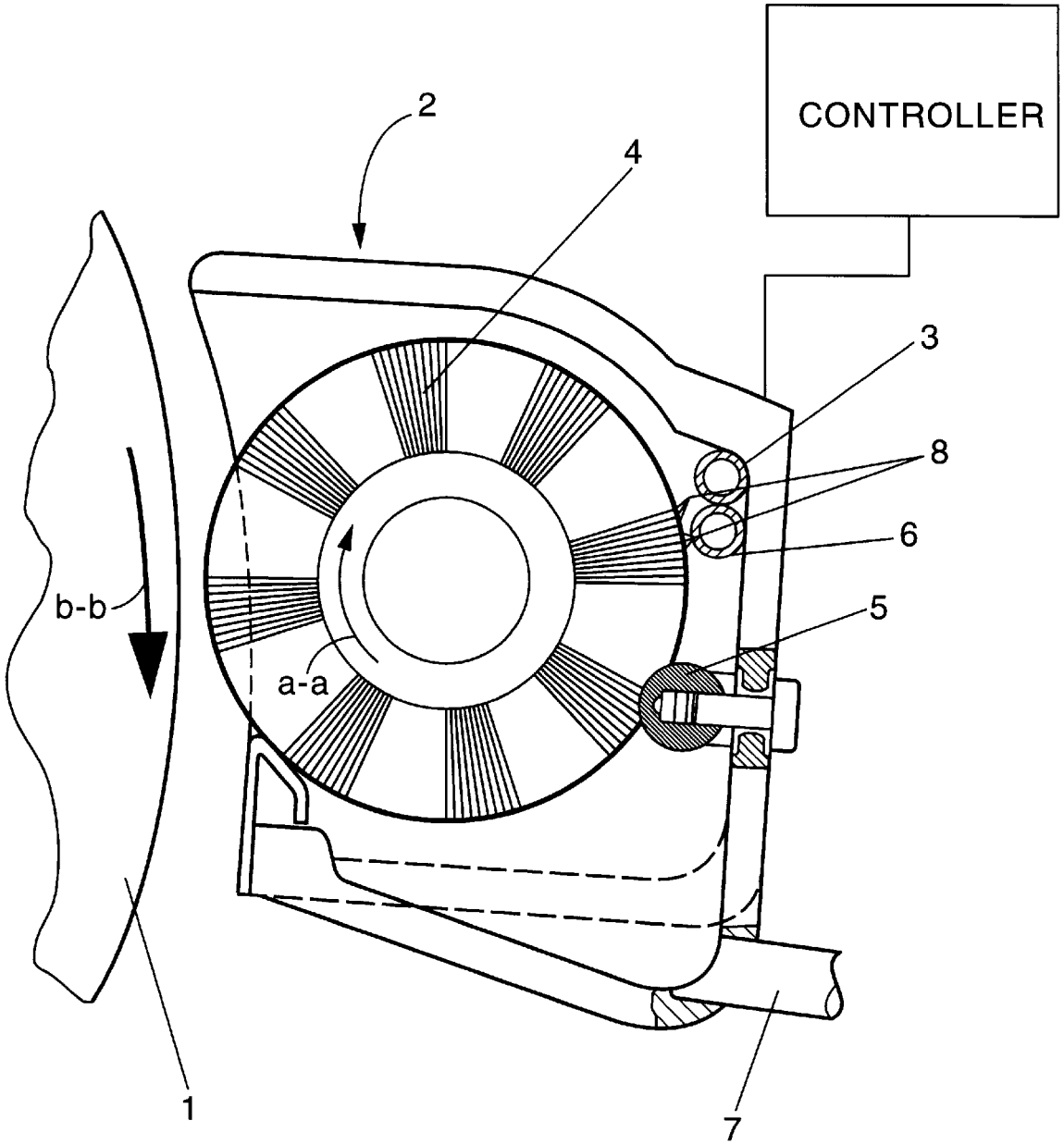
FIG. 1 is a diagrammatic depiction of the washing device according to the invention in which the washing roller is not in contact with the printing cylinder.

While the invention is susceptible to various modifications and alternate constructions, a certain illustrated embodiment has been shown in the drawings and will be described in detail below. It should be understood, however, that there is no intention to limit the invention to the specific form disclosed. On the contrary, the intention is to cover all modifications, alternative constructions, and equivalents falling within the spirit and scope of the invention.

Figure 2:
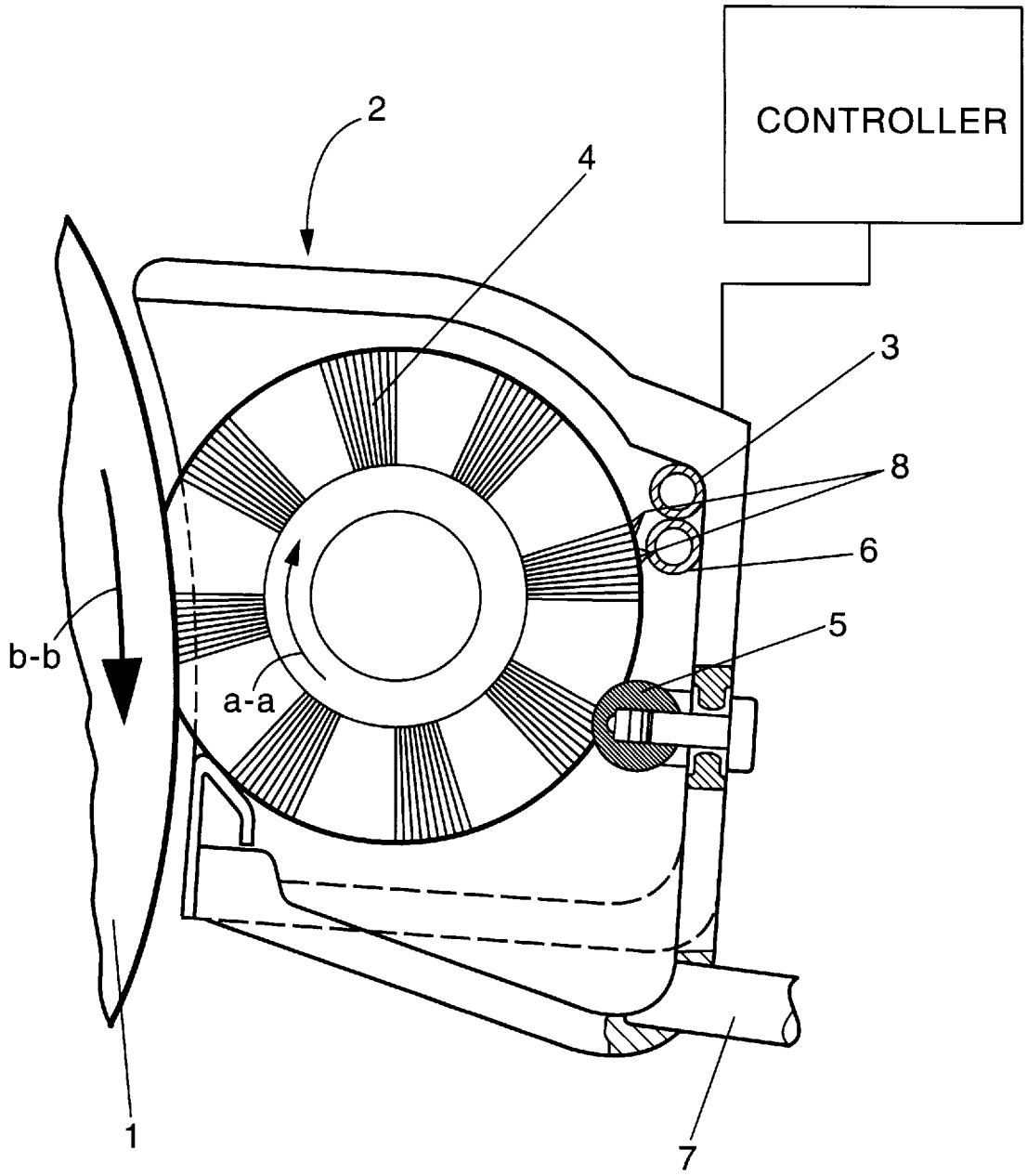
FIG. 2 is a diagrammatic depiction of the washing device according to the invention in which the washing roller is in contact with the printing cylinder.

FIG. 1 illustrates a washing device 2 in a position such that the washing roller 4 is not in contact with the printing cylinder 1. The washing roller 4 is rotatable in the direction of rotation a—a. The printing cylinder 1 is rotatable in the direction of rotation b—b. It is to be understood that, in a given printing press, the printing cylinder 1 and the washing roller 4 can be made to rotate in the opposite directions as the ones depicted. Generally in any given printing press, however, the direction of rotation of the washing roller is the opposite of the direction of rotation of the printing cylinder. The washing roller 4 depicted in FIGS. 1 and 2 is a brush roller. It is to be understood, however, that the washing roller 4 can also be covered by different materials, e.g., felt, cloth, etc.

When the printing machine is first started after a long standstill period (or during periods in which the washing operation is not performed), the washing device 2 is maintained in the position depicted in FIG. 1 such that the washing roller 4 is not in contact with the printing cylinder 1. When the washing operation is being performed, the washing device 2 is actuated to the position depicted in FIG. 2 such that the washing roller 4 is in rotational contact with the printing cylinder 1.

After a long standstill period, the brush bristles of the washing roller 4 are dry and, therefore, stiffer than when they are wet. The washing device according to the invention premoistens the covering of the washing roller 4 (which in the illustrated embodiment is a brush with bristles) with an amount of washing liquid, or other type of liquid (e.g., water), to sufficiently moisten the covering of the washing roller 4 prior to the first washing operation after a long standstill period of the printing press.

As can be seen in FIG. 1, spray pipes 3 and 6 have openings 8 for spraying any type of desired liquid (e.g., washing liquid, water, etc.) on the covering of the washing roller 4. It can be appreciated that the spray pipes 3 and 6 can spray the same type of liquid or different types of liquid on the washing roller 4. For example, spray pipe 3 may spray washing liquid during the washing operation, whereas spray pipe 6 may spray water to premoisten the covering of the washing roller 4 prior to the first washing operation after a long standstill period of the printing press or rinse the washing roller after completion of the washing operation. The metering blade 5 wipes excess liquid from the surface of the washing roller 4 to avoid overwetting the surface of the printing cylinder 1 and to minimize consumption of washing liquid. The excess liquid is then drained from the washing device 2 through the discharge pipe 7.

Figure 3:
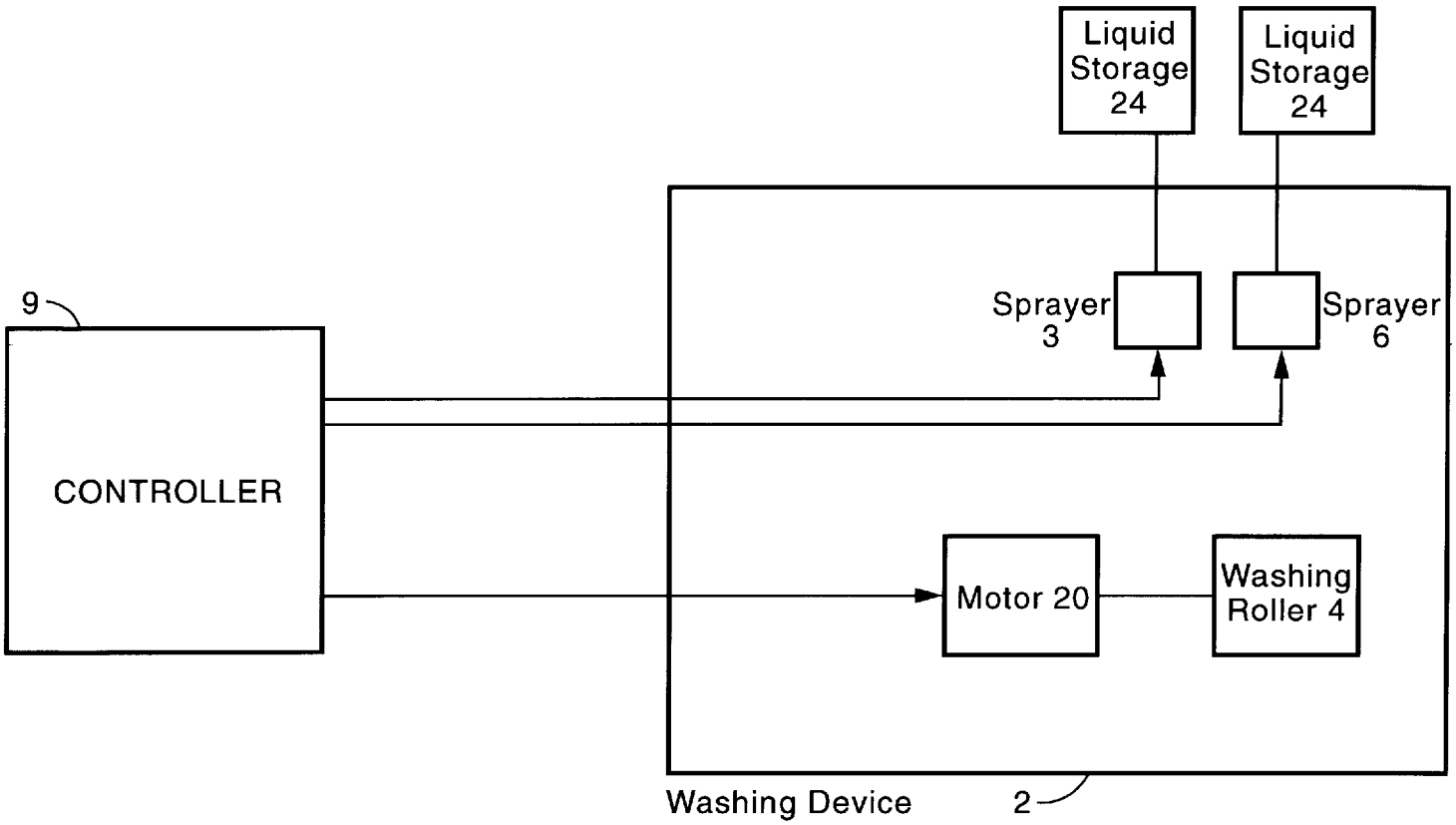
FIG. 3 is a block diagram of the interconnections between the controller and the various components of the washing device 2.

The invention uses a conventional controller 9 to ensure that the covering of the washing roller 4 is always adequately moistened prior to any washing operation. FIG. 3 is a block diagram of the interconnections between the controller and the various components of the washing device 2.

As depicted in FIG. 3, the controller 9 controls the motor 20 which rotates the washing roller 4 of the washing device 2. The controller 9 activates the motor 20 which rotates the washing roller 4 during the premoistening of the washing roller and during the washing operation. The controller 9 also controls the spraying action of the spray pipes 3 and 6 such that the spray pipes 3 and 6 spray liquid on the washing roller 4 at the appropriate times, i.e., during premoistening of the washing roller and during the washing operation. The spray pipes 3 and 6 are provided with a source of liquid (e.g., washing liquid or water) from liquid storages 24. The source of liquid for the spray pipes 3 and 6 can be the same or different. In FIG. 3, the liquid storages 24 are shown to be located apart from the washing device 2. It is to be understood, however, that the liquid storages 24 can also be located in the washing device 2.

Figure 4:
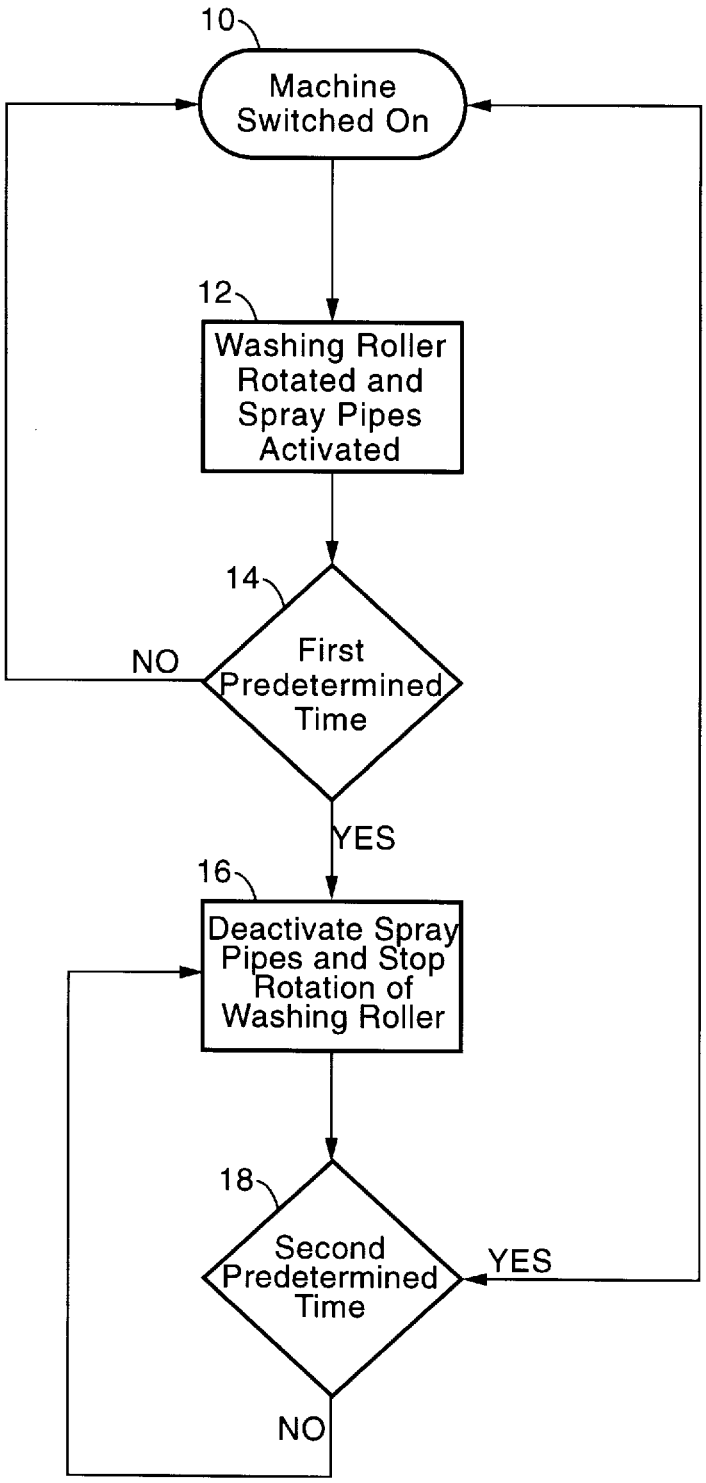
FIG. 4 is a flow diagram representation of the steps executed by the controller to ensure adequate premoistening of the covering of the washing roller prior to the first washing operation after a long standstill period of the printing press.

FIG. 4 is a flow diagram representing the steps that the timer or controller 9 undertakes to ensure adequate premoistening of the washing roller 4. When the printing machine is first started at step 10, the washing device 2 is in a position in which the washing roller 4 is not in contact with the printing cylinder 1, see FIG. 1. With the washing device 2 in this position, at step 12, the washing roller 4 rotates and either or both sprays 3 and 6 spray liquid on the washing roller 4. At step 14, this operation continues until a predetermined amount of time has elapsed. This amount of time is empirically determined by measuring the amount of time required to adequately premoisten the covering of the washing roller 4 with a particular type of liquid.

Once the predetermined amount of time has elapsed, at step 16 the controller stops spraying liquid on the washing roller 4 and stops the motor 20 which rotates the washing roller 4. Stopping the rotation of the washing roller 4 when the covering of the washing roller is adequately moistened, conserves energy and also avoids inadvertent spraying of liquid (from the rotation of the washing roller 4) on the printing cylinder 1 during the printing operation. When the washing operation is performed, the controller 9 will once again activate the motor 20 to rotate the washing roller 4.

To ensure that the covering of the washing roller 4 does not dry between washing operations, even when the printing press has not been switched off, the controller at step 18 counts down a second predetermined amount of time. This second amount of time is empirically determined by measuring the amount of time it takes the covering of the washing roller 4 to dry once it has been adequately moistened. If this second amount of time elapses without the washing device 2 performing a washing operation, then the controller performs the moistening operation again.

What is claimed is:

1. A method for moistening a washing roller used to wash a printing cylinder of an offset rotary printing machine, comprising the steps of:

rotating a washing roller having a covering in a position in which it is not in rotational contact with the printing cylinder prior to a first printing cylinder washing operation;

moistening the washing roller by spraying a liquid on the washing roller while it is not in rotational contact with the printing cylinder;

maintaining a metering blade in contact with the washing roller to wipe excess liquid from the surface of the washing roller;

delaying drawing the washing roller into rotational contact with the printing cylinder until the covering of the washing roller is wet to minimize wear on the covering and avoid damage to the printing cylinder;

drawing the washing roller into rotational contact with the printing cylinder;

disengaging the washing roller from rotational contact with the printing cylinder; and periodically moistening the washing roller after the first washing operation regardless of whether the washing roller is drawn into rotational contact with the printing cylinder again.

2. A method for moistening a washing roller used to wash a printing cylinder of an offset rotary printing machine, comprising the steps:

rotating a washing roller having a covering in a position in which it is not in rotational contact with the printing cylinder prior to a first printing cylinder washing operation;

moistening the washing roller while it is not in rotational contact with the printing cylinder;

delaying drawing the washing roller into rotational contact with the printing cylinder until the covering of the washing roller is wet to minimize wear on the covering and avoid damage to the printing cylinder;

drawing the washing roller into rotational contact with the printing cylinder after the washing roller has been adequately moistened;

moistening the washing roller while it is in rotational contact with the printing cylinder;

disengaging the washing roller from rotational contact with the printing cylinder; and periodically moistening the washing roller after the first washing operation regardless of whether the washing roller is drawn into rotational contact with the printing cylinder again.

3. The method of claim 2, wherein the washing roller is moistened by spraying a liquid on the washing roller.

4. The method of claim 3, wherein the liquid used to moisten the washing roller while it is not in rotational contact with the printing cylinder is water.

5. The method of claim 3, wherein the liquid used to moisten the washing roller while it is in rotational contact with the printing cylinder is washing liquid.

* * * * *